US007591634B2

(12) United States Patent
Wheeler et al.

(10) Patent No.: US 7,591,634 B2
(45) Date of Patent: Sep. 22, 2009

(54) STATOR SHIM WELDING

(75) Inventors: Brian C. Wheeler, Greer, SC (US); Lynn Charles Gagne, Simpsonville, SC (US); Kelvin R. Aaron, Simpsonville, SC (US); Thomas R. Tipton, Greer, SC (US)

(73) Assignee: General Electric Company, Schenectady, NY (US)

( * ) Notice: Subject to any disclaimer, the term of this patent is extended or adjusted under 35 U.S.C. 154(b) by 527 days.

(21) Appl. No.: 11/602,550

(22) Filed: Nov. 21, 2006

(65) Prior Publication Data

US 2008/0118352 A1 May 22, 2008

(51) Int. Cl.
*F01D 9/04* (2006.01)

(52) U.S. Cl. ..... 415/209.3; 415/191; 415/211.2; 29/889.21

(58) Field of Classification Search ..... 415/191, 415/211.2, 209.3, 209.4; 29/889.21
See application file for complete search history.

(56) References Cited

U.S. PATENT DOCUMENTS

| | | | | |
|---|---|---|---|---|
| 2,661,147 | A * | 12/1953 | Anderson | 415/209.3 |
| 3,326,523 | A * | 6/1967 | Bobo | 415/209.3 |
| 5,022,818 | A * | 6/1991 | Scalzo | 415/209.3 |
| 6,733,237 | B2 * | 5/2004 | Ingistov | 415/209.2 |
| 6,984,108 | B2 | 1/2006 | Anderson | |

* cited by examiner

*Primary Examiner*—Ninh H Nguyen
(74) *Attorney, Agent, or Firm*—Edward J. Smith; Ernest G. Cusick; Frank A. Landgraff

(57) ABSTRACT

A method is provided for attaching a shim to at least one of a base of a stator vane unit and a ring segment of a ring segment assembly in a gas turbine compressor. The method includes providing a shim shaped to conform to an engaging face of the base of the stator vane unit or the segment ring of the segment ring assembly, with a predetermined thickness dimension; boring at least one hole, normal to the face of the shim and extending fully through the thickness dimension of the shim; positioning the shim on the engaging face of the at least one of the base of the stator vane unit and the segment ring of the segment ring assembly; and welding the shim to the engaging face of the at least one of the base of the stator vane unit and the ring segment of the stator ring assembly.

20 Claims, 10 Drawing Sheets

STATOR SHIM WELDING

BACKGROUND OF THE INVENTION

The present invention relates to stator vanes used to direct airflow between stages within a compressor of a gas turbine engine. More particularly, this invention relates to a method for increasing the reliability of stator vane structures by welding shims to a base of the stator vane.

A conventional gas turbine generally operates on the principle of compressing air within a compressor, and then delivering the compressed air to a combustion chamber where fuel is added to the air and ignited. Afterwards, the resulting combustion mixture is delivered to the turbine section of the engine, where a portion of the energy generated by the combustion process is extracted by a turbine to drive the compressor via a shaft.

In multi-stage compressor sections, stators are placed at the entrance and exit of the compressor section, as well as between each compressor stage, for purposes of properly directing the airflow to each successive compressor stage. As a result, the stators are able to enhance engine performance by appropriately influencing air flow and pressure within the compressor section.

Stators generally consist of an annular array of airfoils, or vanes. Stators are typically formed in segments as stator vane units consisting of one or more airfoils supported by the base. These stator vane units are then individually mounted to the compressor casing to form an annular array, so that the airfoils project radially between an adjacent pair of stages.

Stator vanes in an industrial gas turbine compressor are loaded and unloaded during start-stop cycles. In addition, the vanes are subject to small pressure fluctuations during operation. These result in relative motion between the vane base and the casing in which the vanes are assembled. The relative motion results in wear of both the vane base and casing, which, in turn, results in loose vanes. The loose vanes become more susceptible to relative motion and begin to chatter. Expensive repair or replacement of the vanes and casing does not solve the wear and chatter problem; it simply begins the process anew. Repair and/or replacement of the vanes and casing are expensive. Similar problems exist between stator ring segments, which hold a plurality of stator vane units, the stator ring segments being mounted in slots of the compressor casing.

FIG. 1 illustrates a compressor section 10 showing a portion of an open casing 15 of a compressor showing five exemplary stages (rows) 20*a*-20*e* of stator vane units 25. In the embodiment shown, the casing section 15 is semicircular. The casing 15 has a mounting surface 30 that may be secured to a corresponding mounting surface on another casing section with fasteners extending through a plurality of holes 35. For a complete compressor, two of the semicircular casing sections would be fitted together around a rotor (not shown).

Each stator vane unit 25 has the airfoil vane 40 that extends upwards from a base 45 and radially inward towards the shaft of the compressor rotor (not shown). The airfoil vanes 40, stator vanes, are interposed between the rotor blades (not shown). Certain stator stages of a compressor may mount stator vane units directly in a slot in the casing. Other stator stages mount stator vane units in ring segments, which are then mounted in slots of the casing. Both types of mounting will be described in more detail.

FIG. 2 illustrates individual stator vane units. Airfoil vane 40 extends vertically from a base 45. The base 45 has two opposing retaining faces 50. The base 45 has a pair of projections 55, one on each of the retaining faces. The projections 55 are to be received by a correspondingly shaped groove in a slot of the casing. The grooves retain the stator vane unit 25 in place in the slot of the casing. The other two opposing faces of the base 45 are the engaging faces 60. The engaging faces 60 of base 45 butt against the bases 45 of adjacent stator vane units when the units are installed in a casing slot.

FIG. 3 illustrates an enlarged side view of the casing showing a stage in which individual stator vane units are assembled in a slot of the compressor casing. For this type of installation, a plurality of the stator vane units are assembled in the casing to form the stator vane stage. The casing 15 has a plurality of slots 70 for receiving the stator vane units 25. The slot 70 has a pair of side edges 75, which each has a groove or dovetail-shaped recess 80. The square base dovetail 80 holds the vane units 25 in place. Each vane unit 25 is allowed to slide into place with the base 45 received in the slot 70 and the projections 55 received in the grooves 80. The casing 15 in the particular embodiment shown has the air extraction cavity 85 that underlies the stage and is formed by the slot 70 and the stator vane units 25. While a square base 45 for the vane unit 25 is shown, it is recognized that other shapes may be desired dependent on the number, size and shape of the airfoil. For example, the base 45 can have a rectangular shape or a parallelogram shape.

The stator vane units 25 for an individual stage are sequentially placed in the slot 70 of the casing 15 until the full circumferential run of the slot has been filled with a designated number of stator vane units.

Other stages of stator vanes may be attached to the casing using ring segment assemblies. The ring segment assembly includes a ring segment and a stator vane unit. Ring segments hold a plurality of stator vane units. After the ring segments have been loaded with stator vane units, the ring segments are slid into circumferential slots in the turbine casing and are butted against each other to sequentially fill the circumferential slots. Blades that are larger and have more forces placed on them may be assembled using this vane and ring segment assembly to provide a stiffer base mount.

FIG. 4 illustrates a ring segment assembly 85 that is slid out and away from the casing 15. The ring segment 90 receives a plurality of stator vane units 25. A base 45 of the stator vane units 25 slides (in a generally axial direction with respect to the compressor) into the ring segment 90. The base 45 of the stator vane unit 25 includes a dovetail 95 fitting into and being retained by a corresponding dovetail-shaped slot 100 in the ring segment 90.

The ring segment 90 slides into the circumferential slot 70 of the casing 15. The sidewalls 105 of the ring segment 90 are supported axially by the sidewalls 110 of the slot 70 when the ring segment 90 is within the slot 70. The square base dovetail 115 of the ring segment 90 fits into the grooves 120 of the circumferential slot 70, thereby retaining the ring segments 90 in the circumferential slot 70. Ring segments 90 are sequentially placed in the slot 70 of casing 15 until the slot 70 is filled with the design number of ring segment assemblies.

Any circumferential gap of unfilled slot space that remains after the last vane unit has been installed in the casing slot or the last ring segment has been inserted shall be filled by shims to maintain a design fit. The shims space the bases of the vane units or ring segments so that the engaging face of the last installed is within an allowable clearance with edge 140 of the casing. Failure to maintain design will result in vibration and excessive wear of components, possibly leading to failure during operation. At least one shim may be placed between the last and next-to-last space between stator vane units or ring segments or may be placed between the plurality of the stator vane units or the plurality of the ring segments.

FIG. 2 further shows a shim 130 spaced between two stator vane units 25. The shim 130 inserted between the engaging faces 60 of the stator vane units 25 are shaped generally conforming to the shape of the engaging face of the base 45 of the stator vane unit 25. The shim includes tabs 135 that engage (FIG. 3) the grooves 80 of the slots 70 of the casing 15, thereby helping to retain the shim 130 within the slot 70. Shims may be similarly employed to close gaps between segment rings, for those stages that employ the segment rings to hold stator vane units in place in the casing slots (not shown).

In the prior art, with the vane units and the shims moving because of aerodynamic forces on the airfoils, the tabs 135 wear away and the shims 150 can protrude into the flow path as seen in FIG. 5. FIG. 5 illustrates a sectional view of a casing with a shim protruding between stator vane units. Here, the engaging face 60 of the base 45 of the stator vane unit extends fully to the edge 140 of the casing 15 due to insertion of one or more shims in gaps 145 between the bases 45 of the stator vane units 25. A protruding shim 150 is shown that has partially protruded out of the gap 145 between the bases. Protruding shims can cause rotating blade stimulation and flow blockage. In addition, the shims can work their way totally out of the slot 70 in the casing 15 and enter into the air stream and cause blade foreign object damage (FOD) on downstream blades and vanes.

FIG. 6 illustrates protrusion of two shims 150 from the gap 145 between the bases 45 of two stator vane units 25. Attempts have been made to fix shims, in place and in different ways, in order to overcome this problem. FIG. 7 illustrates an existing method for retaining shims in place on stator vane units using drive pins. In this process, holes 125 must be drilled through the shim 130 and into at least one location on the engaging face 60 of a base 45 of the stator vane unit 25. Each stator vane unit type has different locations at which the holes must be drilled. The method also requires the added hardware of the drive pins. Anderson et al. (U.S. Pat. No. 6,984,108) addresses shims for stator vanes in gas turbine compressors. Anderson et al. attempts to prevent repositioning or release of shims into the turbine flow stream by a series of dowel pieces, positioned between adjacent bases for stator vanes. The dowel pieces fit into recesses in the adjacent base sections of the stator vanes. The dowel pieces are spring loaded and run through a hole in the center of the shim, thereby maintaining the shim in place. However, the spring loaded dowel pieces entail complexity with inherent potential for failure.

Accordingly, there is a need to provide a simple method for retaining shims on stator vane units and stator ring segments. The method should preferentially be simple and minimize requirements for additional hardware

BRIEF DESCRIPTION OF THE INVENTION

The present invention relates to a method for retaining shims in place in a gas turbine compressor and in particular for retaining shims in place between adjacent stator vane units and between adjacent stator ring segments.

Briefly in accordance with one aspect of the present invention, a stator vane unit for a gas turbine is provided. Each stator vane unit includes a base. The base incorporates a pair of engaging surfaces located circumferentially relative to a casing of the gas turbine when the stator vane unit is installed in the casing and a pair of opposing retaining surfaces located axially relative to the casing of the gas turbine when the stator vane unit is installed in the casing. The stator vane unit also includes an airfoil vane projecting from the base and a shim welded to one engaging face of the base.

The shim includes a dimension of thickness sized to maintain tightness of the stator vane units when installed in slots around a periphery of the casing of the compressor. The shim defines a hole that fully penetrates the thickness dimension of the shim to the engaging face of the base. The shim may be welded to the engaging surface of the base through the hole. The hole may be structured as a right cylindrical cavity normal to the engaging face of the base. Alternatively, the hole may be structured as an oval-shaped cavity normal to the circumferential surface of the base, where the oval includes a rectangular center section, closed by a hemispherical section on each end. The shim may further include at least one tab projecting from each the retaining face, for mating with corresponding grooves in slots of the casing of a compressor.

According to a second aspect of the invention, a ring assembly for a gas turbine is provided. The ring segment assembly includes a ring segment, a plurality of stator vane units, and a shim welded to at least one engaging face of the ring segment. The ring segment includes a pair of engaging surfaces located circumferentially relative to a casing of the gas turbine when the ring segment is installed in the casing and a pair of opposing retaining surfaces located axially relative to the casing of the gas turbine when the ring segment is installed in the casing.

A shim includes a dimension of thickness sized to maintain tightness of the ring segments when installed in slots around a periphery of the casing of the compressor. The shim defines a hole that fully penetrates the thickness dimension of the shim to the engaging face of ring segment. The shim may be welded to the engaging surface of the ring segment through the hole. The hole may be structured as a right cylindrical cavity normal to the engaging face of the base. Alternatively, the hole may be structured as an oval-shaped cavity normal to the engaging face of the ring segment, where the oval includes a rectangular center section, closed by a hemispherical section on each end. The shim may further include at least one tab projecting from each the retaining face, for mating with corresponding grooves in slots of the casing of a gas turbine.

According to a further aspect of the invention, a method is provided for attaching a shim to at least one of a base of a stator vane unit and a ring segment of a ring segment assembly. The method includes providing a shim shaped to conform to an engaging face of the at least one of the base of the stator vane unit and the segment ring of the segment ring assembly, including a predetermined thickness dimension; boring at least one hole, normal to the face of the shim and extending fully through the thickness dimension of the shim; positioning the shim on the engaging face of the at least one of the base of the stator vane unit and the segment ring of the segment ring assembly; and welding the shim to the engaging face of the at least one of the base of the stator vane unit and the ring segment of the stator ring assembly.

The step of providing at least one bored hole includes boring a hole normal to a face of the shim. The step of providing a predetermined thickness of the shim includes selecting a shim of the predetermined thickness from a set of shims of predetermined thicknesses. The step of selecting the shim of the predetermined thickness further includes choosing the predetermined thickness in consideration of closing a circumferential gap remaining when the design number of the stator vane units or the design number of the ring segments are installed.

The step of providing at least one bored hole includes boring a hole generally centered with respect to the face of the shim and may include boring a generally circular-shaped hole. Alternatively, boring may produce a generally oval-shaped hole, where the oval-shape consists of a rectangular-shaped center portion with a semicircular section to each side of the rectangular-shaped center.

The step of welding the shim further includes fill welding the shim, though the hole bored in the shim, to the at least one of the stator vane unit and the segment ring.

BRIEF DESCRIPTION OF THE DRAWING

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

The following embodiments of the present invention have many advantages, including attaching shims directly to engaging surfaces of stator vane units and ring segments to preclude dislocation of the shims during equipment operation with protrusion into the gas flow stream or foreign object damage.

Prior art method have provided shims that may be held in place by drive pins fixing the shims to an engaging face of a stator vane unit or a segment ring. Spring-loaded dowels are available to fit in holes in the engaging face of adjacent stator vane units or segment rings and which extend through a hole in a shim interposed between the adjacent engaging faces. These methods for retaining shims require additional pieces (drive pins or spring-loaded dowels). The methods also result in greater complexity of installation, particularly if the dowels are to be installed between many or all adjacent stator vane units or segment rings.

A simple, but extremely effective, method to provide positive capture for shims interposed between adjacent engaging faces of the bases of the stator vane units or between engaging faces of the segment rings is to directly weld the shims to one of the engaging faces.

Figure 1:
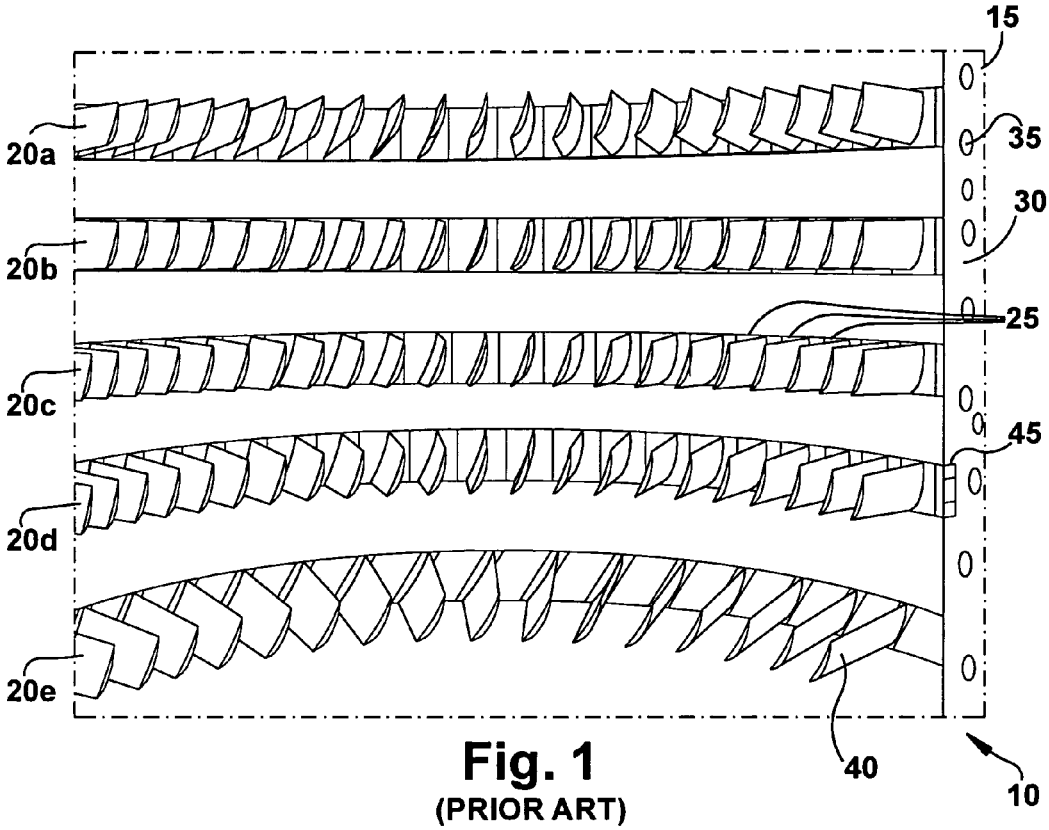
Fig. 1 (PRIOR ART)
FIG. 1 illustrates a compressor section including a portion of an open compressor casing showing five exemplary stages of stator vane units.
Figure 2:
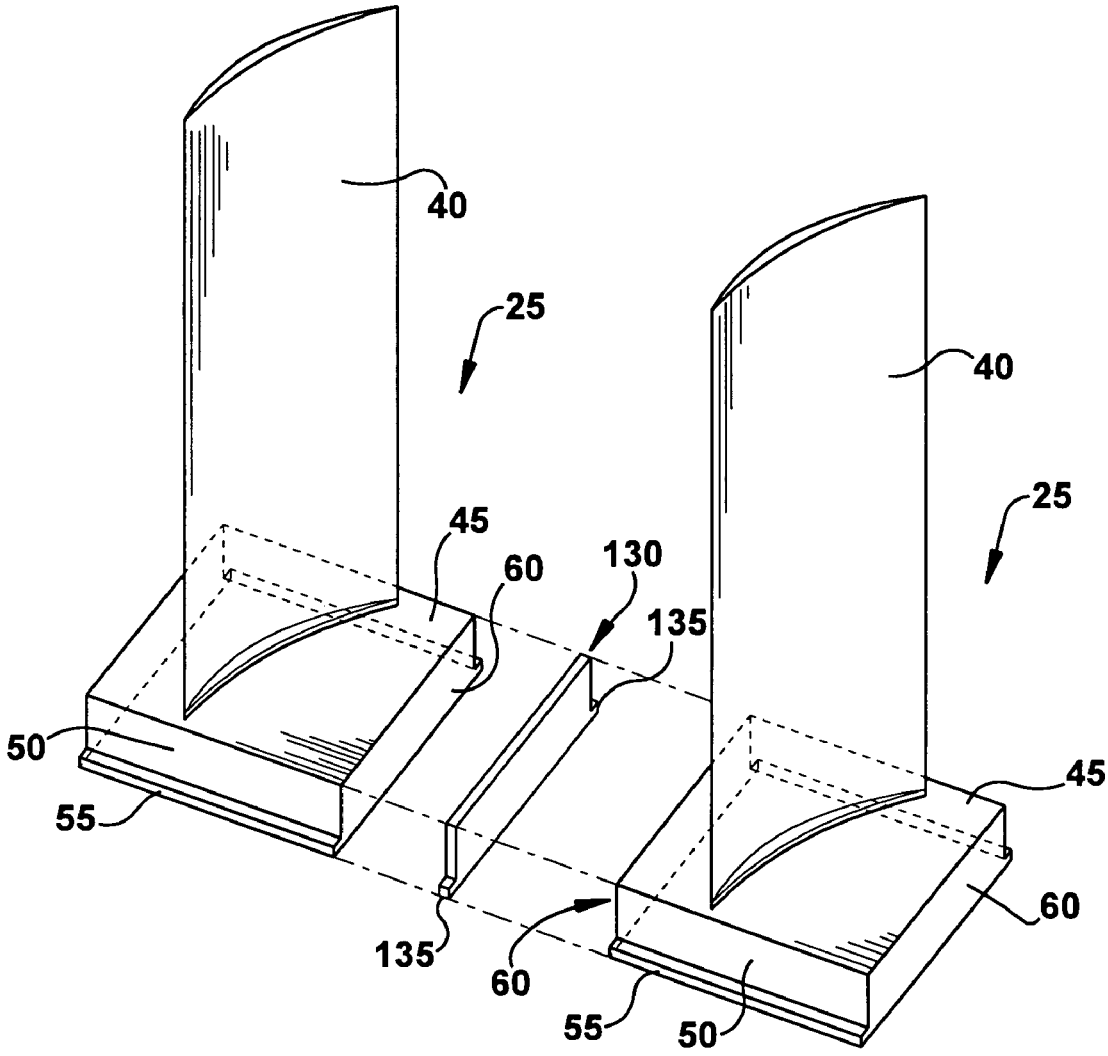
Fig. 2 (PRIOR ART)
FIG. 2 illustrates individual stator vane units.
Figure 3:
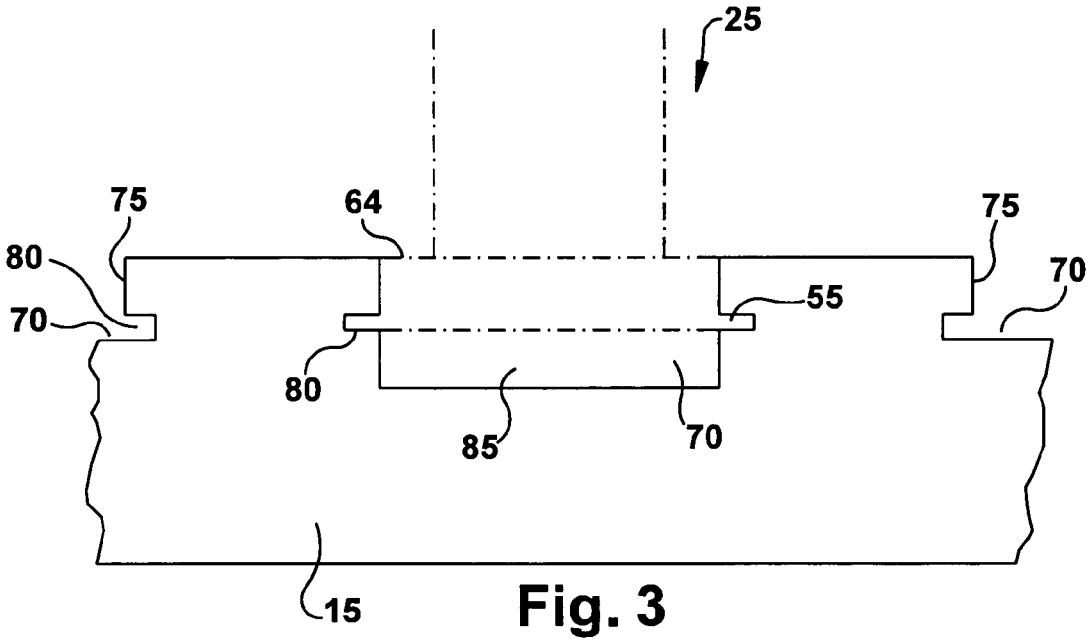
Fig. 3 (PRIOR ART)
FIG. 3 illustrates stator vane unit assembled in a slot of the turbine casing.
Figure 4:
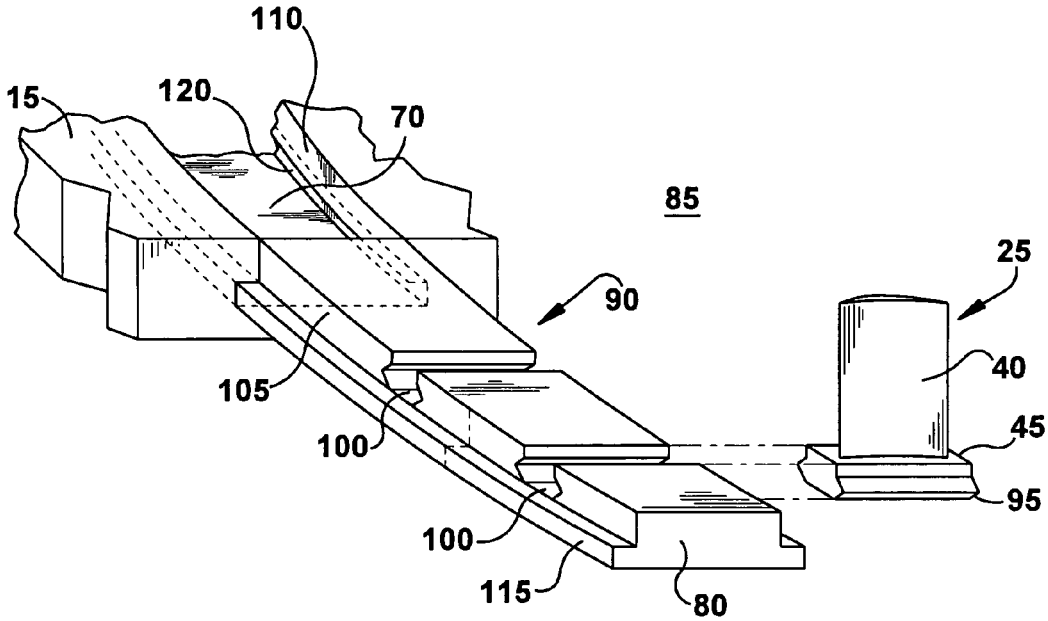
Fig. 4 (PRIOR ART)
FIG. 4 illustrates a ring segment assembly slid out from the turbine casing slot.
Figure 5:
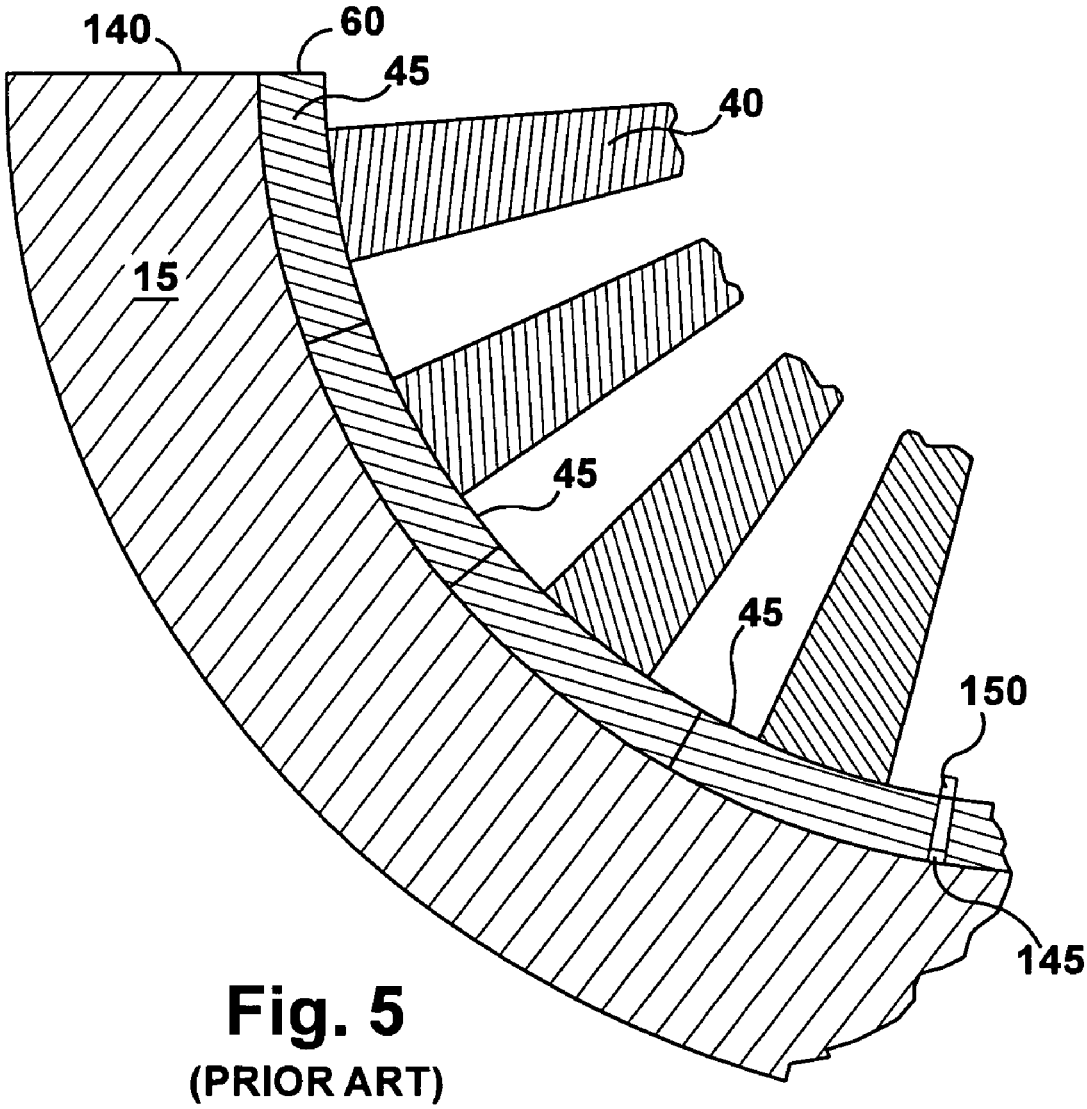
Fig. 5 (PRIOR ART)
FIG. 5 illustrates a sectional view of a compressor casing with a shim protruding between stator vane units.
Figure 6:
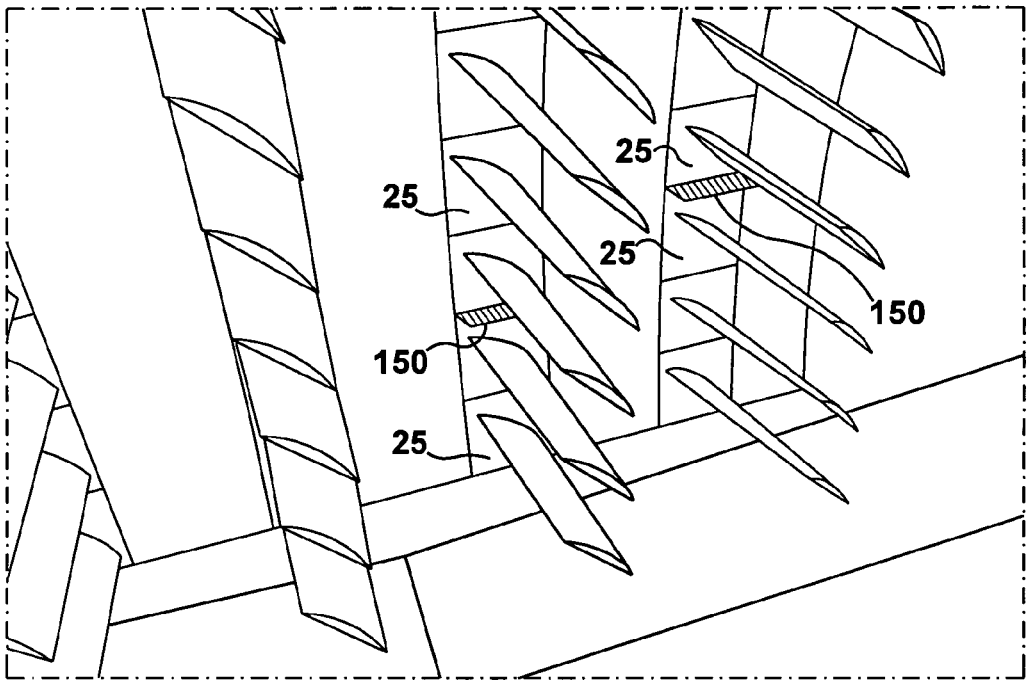
Fig. 6 (PRIOR ART)
FIG. 6 illustrates protrusion of shims between stator vane units in a compressor casing slot.
Figure 7:
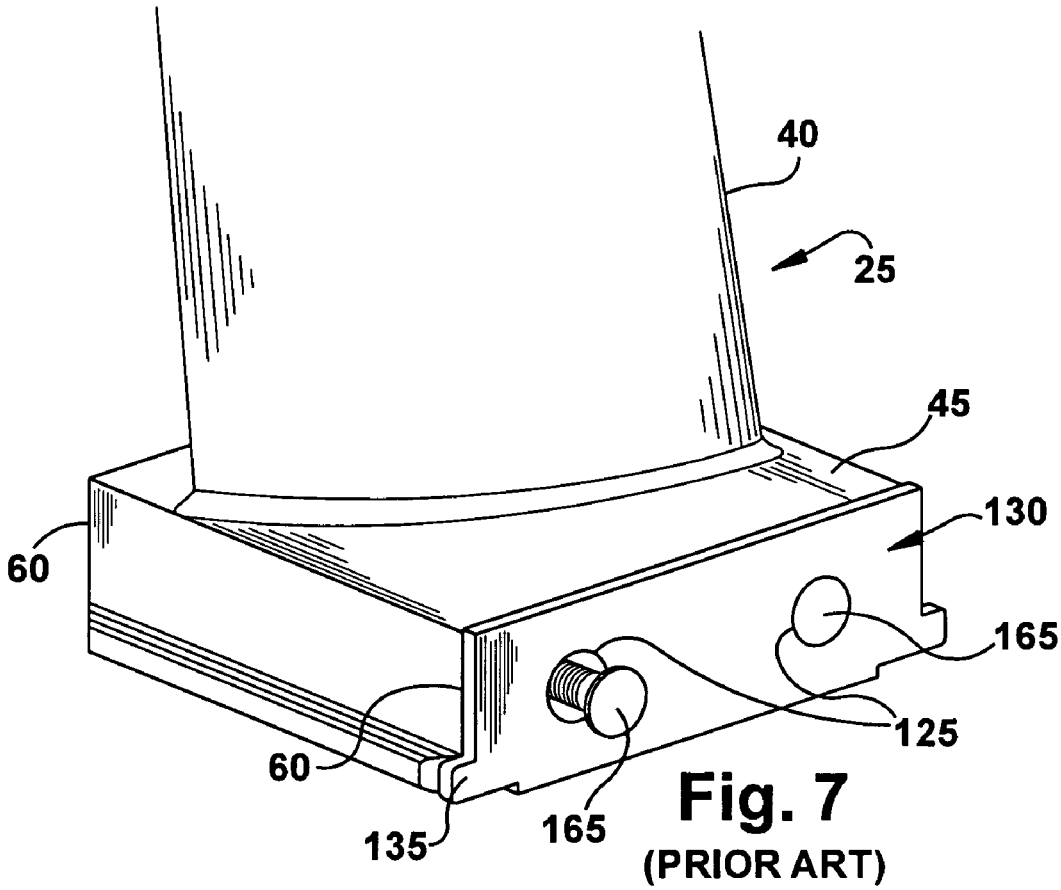
Fig. 7 (PRIOR ART)
FIG. 7 illustrates an existing method for retaining shim in place on stator vane units with drive pins.
Figure 8A:
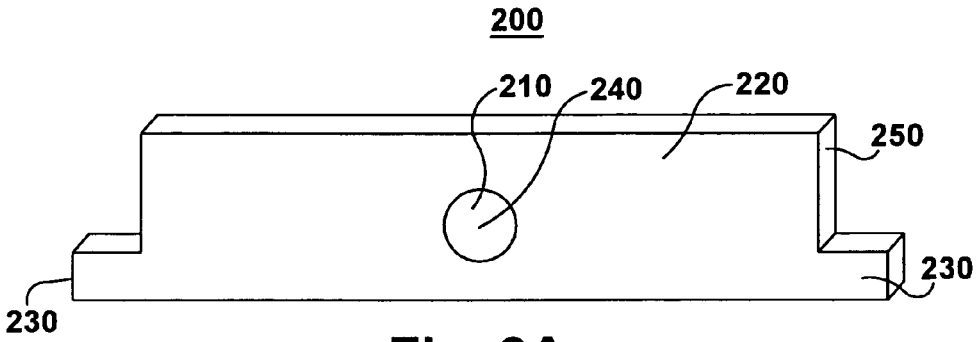
FIG. 8A illustrates an exemplary shim with a circular hole.

FIG. 8A illustrates an exemplary shim 200 defining a circular hole 210. The shim 200 is manufactured with the shape of surface 220 including tabs 230 and generally conforms to the engaging face of the base of the stator vane unit (not shown). The circular hole 210 is centered 240 on the engaging surface 220 of the shim 200. The circular hole fully extends through a thickness dimension 250 of the shim. The diameter of the hole may vary between about ¼ in. to about ½ in.

Figure 8B:
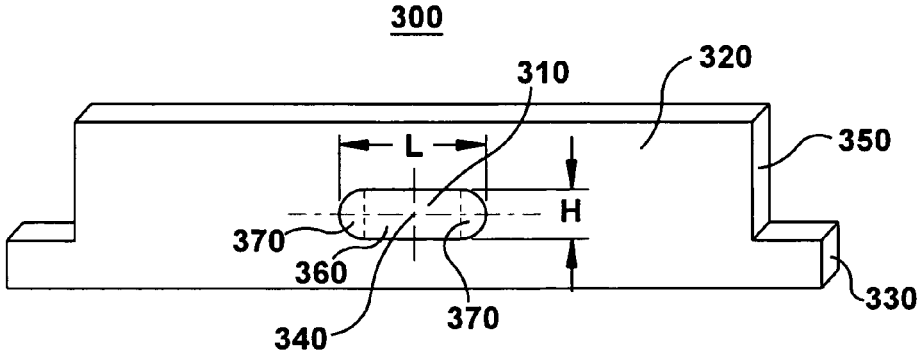
FIG. 8B illustrates an exemplary shim with an oval-shaped hole.

FIG. 8B illustrates an exemplary shim 300 defining an oval shaped hole 310. The shim 300 is manufactured with the shape of surface 320 including tabs 330 generally conforming to the engaging face of the base of the stator vane unit (not shown). The oval-shaped hole 310 is positioned 340 on the engaging surface 320 of the shim. The oval-shaped hole 310 fully extends through a thickness dimension 350 of the shim. The oval shape may consist of a rectangular-shaped center section 360 with a semicircular section 370 to each side of the rectangular-shaped center. The oval shaped hole may be sized about ¼ in. to about ½ in.

The shim is positioned on the engaging surface of stator vane unit or the ring segment to which it is to be welded. For this process, it is customary that the stator vane unit or the ring segment be removed from its respective casing slot. Normal care must be taken to properly align the engaging face of the shim with engaging face of the base or ring segment to which it is welded. Any overlap of the shim beyond the engaging surface of the surface to which it is welded may interfere with the ability of the combined part to slide through the slot in the casing.

Figure 9:
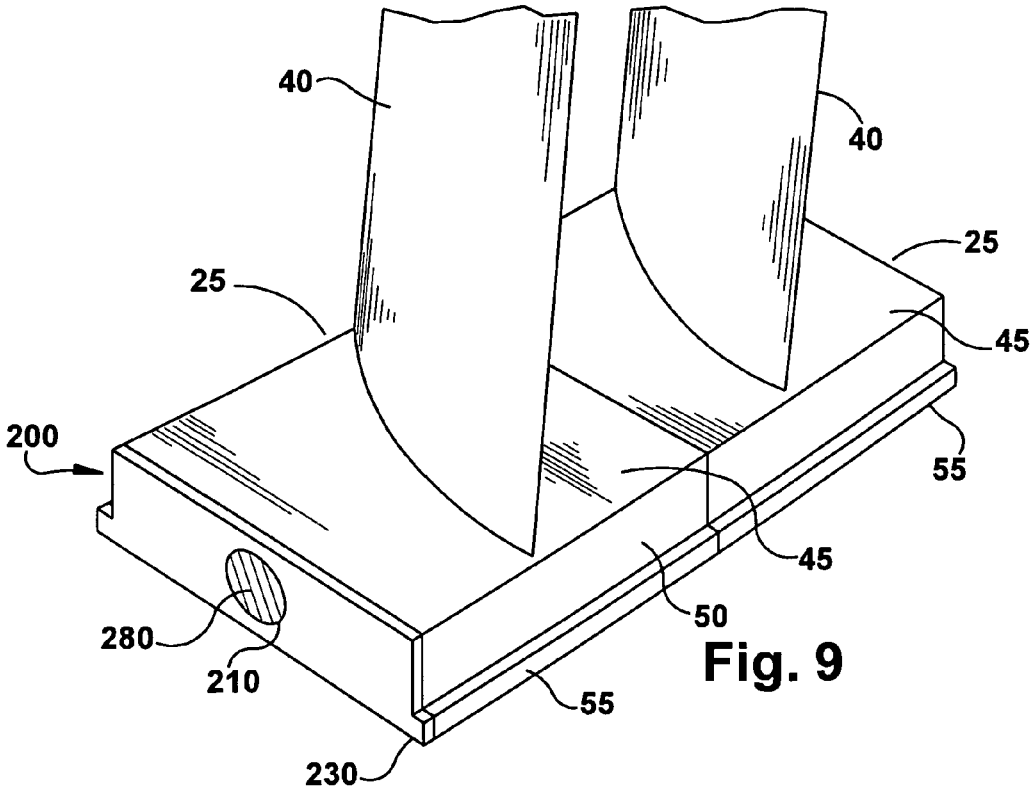
FIG. 9 illustrates a shim welded to a stator vane unit.
Figure 10:
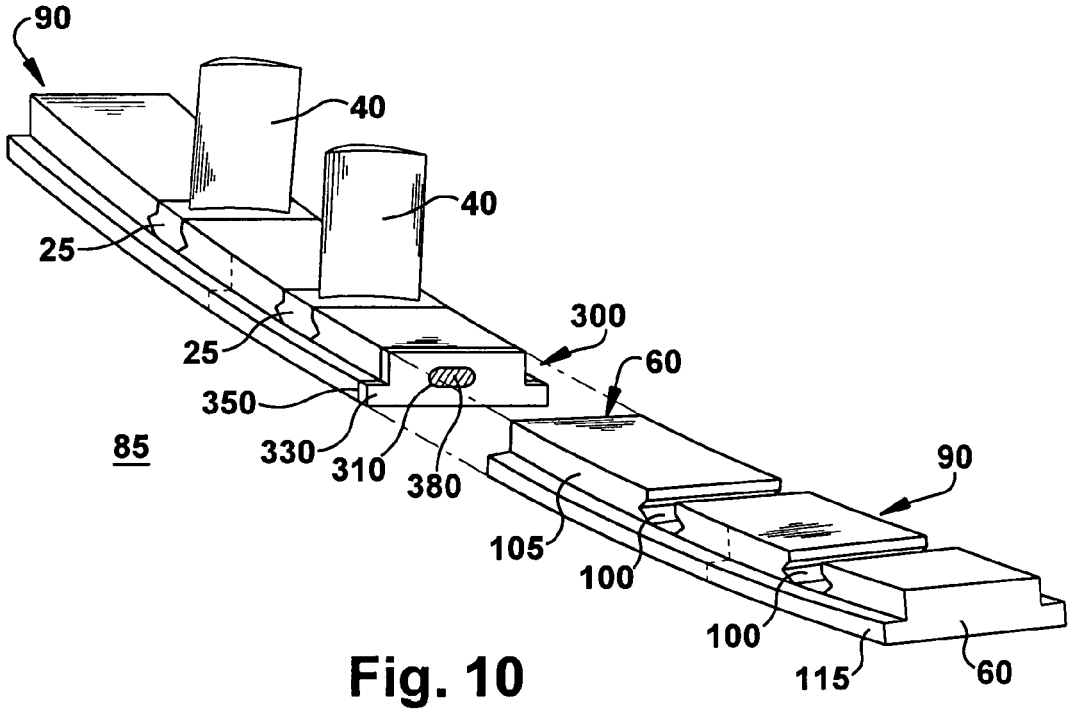
FIG. 10 illustrates a shim welded to a ring segment assembly

FIG. 9 illustrates a shim 200 welded to the stator vane unit 25 with fill weld 280 according to inventive method through a circular hole 210. FIG. 10 illustrates a shim 300 welded to a ring segment 90 through fill weld 380 according to the inventive method through an oval-shaped hole 310. However, either shaped cavity may be used for attachment to both the stator vane unit and the ring segment assembly. Further, while circular and oval-shaped holes have been described, the invention is not restricted to these forms and other shaped cavities may be employed for fill welding.

In some applications, the engaging faces of the adjacent stator vane units or segment rings may be radial, thereby resulting in pie-segment shaped gaps between the adjacent units. In this case the thickness of the shim may be expand from the inboard surface to the outboard surface with respect to the axis of the turbine. In other applications, the engaging surfaces of the stator vane units or segment rings may already be tapered. In this case, the thickness dimension of the shim may be constant over the entire engaging surface. The shims may be fabricated to a set of predetermined thicknesses or the shim may be cut to a specific thickness.

According to the method, a shim is provided that generally conforms to the shape of an engaging surface of the stator vane unit or the ring segment to which the shim is to be attached. The retaining faces of the shim may have identical surface profiles to the surface of the retaining face to which it is to be attached and to the adjacent retaining face to which it butts. The shim may preferentially include tabs for engaging the slot of the casing or ring segment, as applicable. However, the shape for the engaging surfaces of the shim may also be of a lesser shape than the full surfaces to which it is welded or against which it is butted.

The method includes creating a hole in the engaging surface of the shim. The hole is created normal to the surface of the engaging face of the shim and fully extending though to the opposing engaging face of the shim. The positioning of the hole is generally centered on the surface area of the engaging surface for the shim. The shim may preferentially be delivered from a vendor with the hole in place or the hole may be created in a prior art shim, delivered without a hole. The step of creating a hole may further include drilling, boring or using any other suitable technique known in the art. The step of creating a hole may also include creating a circular hole or an oval-shaped hole. The circular hole may nominally be created with a diameter of about ¼ in. to about ½ in. An oval-shaped hole may be sized as about ¼ in. to ½ in.

The method then includes positioning the engaging surface of the shim and the engaging surface in alignment. The step of positioning may further include fixing the aligned engaging surfaces of the shim and the adjacent stator vane unit or ring segment by clamping or other known fixing means in preparation for welding.

The method further includes welding the shim to the engaging surface of the stator vane unit or the segment ring. The step of welding may preferentially include fill welding the engaging surface of the stator vane unit or the ring segment to the shim through the hole in the engaging surface of the shim. Following the welding, the step includes restoring, if needed, the non-welded engaging surface of the shim around the hole. This may include grinding and polishing the non-welded engaging surface of the shim to maintain planarity for butting against the adjacent stator vane unit or ring segment. Welding is performed according to standard fill welding procedure or other suitable welding procedure employed, known in the art, for the alloy material of the shim with the stator vane unit or ring segment.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A stator vane unit for a gas turbine compressor, the vane unit comprising:

a base, including a pair of engaging surfaces located circumferentially relative to a casing of the compressor when the stator vane unit is installed in the casing and a pair of opposing retaining surfaces located axially relative to the casing of the gas turbine compressor when the stator vane unit is installed in the casing;

an airfoil vane projecting from the base; and a shim welded to at least one engaging face of the base.

2. The stator vane unit according to claim 1, the shim comprising a dimension of thickness sized to maintain tightness of the stator vane units when installed in slots around a periphery of the casing of the gas turbine.

3. The stator vane unit according to claim 2, the shim defining a hole fully penetrating the thickness dimension of the shim to the engaging face of the base, through which the shim may be welded to the engaging surface of the base.

4. The stator vane unit according to claim 3, the hole comprising a right cylindrical cavity normal to the engaging face of the base.

5. The stator vane unit according to claim 3, the hole comprising an oval-shaped cavity normal to the circumferential surface of the base, where the oval includes a rectangular center section, closed by a hemispherical section on each end.

6. The stator vane unit according to claim 3, where the shim comprises at least one tab projecting from each retaining face of the base for mating with corresponding grooves in slots of the casing of a gas turbine compressor.

7. A ring assembly for a gas turbine compressor, the ring segment assembly comprising:

a ring segment including, a pair of engaging surfaces located circumferentially relative to a casing of the gas turbine when the ring segment is installed in the casing and a pair of opposing retaining surfaces located axially relative to the casing of the gas turbine compressor when the ring segment is installed in the casing;

a plurality of stator vane units; and a shim welded to at least one engaging face of the ring segment.

8. The ring assembly according to claim 7, the shim comprising a dimension of thickness sized to maintain tightness of the ring segment assembly when installed in slots around a periphery of the casing of the gas turbine compressor.

9. The ring assembly according to claim 8, the shim defining a hole fully penetrating the thickness dimension of the shim to the engaging face of the ring segment, through which the shim may be welded to the engaging surface of the ring segment.

10. The ring assembly according to claim 9, the hole comprising a right cylindrical cavity normal to the engaging face of the ring segment.

11. The ring assembly according to claim 10, where the shim comprises at least one tab projecting from each the retaining faces of the ring segment, for mating with corresponding grooves in slots of the casing of a gas turbine compressor.

12. The ring assembly according to claim 9, the hole comprising an oval-shaped cavity normal to the circumferential surface of the ring segment, where the oval includes a rectangular center section, closed by a hemispherical section on each end.

13. A method for attaching a shim to at least one of a base of a stator vane unit and a ring segment of a ring segment assembly, the method comprising:

providing a shim shaped to conform to an engaging face of the at least one of the base of the stator vane unit and the segment ring of the segment ring assembly, including a predetermined thickness dimension;

boring at least one hole, extending fully through the thickness dimension of the shim;

positioning the shim on the engaging face of the at least one of the base of the stator vane unit and the segment ring of the segment ring assembly; and welding the shim to the engaging face of the at least one of the base of the stator vane unit and the ring segment of the stator ring assembly.

14. The method for attaching a shim according to claim 13, the step of providing at least one bored hole comprising boring a hole normal to a face of the shim.

15. The method for attaching a shim according to claim 14, the step of providing a predetermined thickness of the shim comprising: selecting a shim of the predetermined thickness from a set of shims of predetermined thicknesses.

16. The method for attaching a shim according to claim 15, the step of selecting the shim of the predetermined thickness further comprising: choosing the predetermined thickness in consideration of closing a remaining circumferential gap when installed the design number of the stator vane units and the ring segments.

17. The method for attaching a shim according to claim 14, the at least one bored hole comprising a hole generally centered with respect to the face of the shim.

18. The method for attaching a shim according to claim 14, the step of boring at least one hole comprising: boring a generally circular-shaped hole.

19. The method for attaching a shim according to claim 14, the step of boring at least one hole comprising: boring a generally oval-shaped hole, the oval-shape consisting of a rectangular-shaped center portion with a semicircular section to each side of the rectangular-shaped center.

20. The method for attaching a shim according to claim 14, the step of welding the shim further comprising: fill welding the shim, though the hole bored in the shim, to the at least one of the stator vane unit and the segment ring.

* * * * *